US006435305B1

(12) United States Patent
Ward

(10) Patent No.: US 6,435,305 B1
(45) Date of Patent: Aug. 20, 2002

(54) STACKABLE STEP STOOL

(75) Inventor: Eric A. Ward, Telford, TN (US)

(73) Assignee: MECO Corporation, Greeneville, TN (US)

( * ) Notice: Subject to any disclaimer, the term of this patent is extended or adjusted under 35 U.S.C. 154(b) by 115 days.

(21) Appl. No.: 09/087,775

(22) Filed: May 29, 1998

(51) Int. Cl.[7] ..... A47C 16/00

(52) U.S. Cl. ..... 182/178.1; 297/423.41; 182/222

(58) Field of Search ..... 182/222, 178.1; 108/91, 155, 156, 158; 297/239, 423.41, 423.45; D6/349, 352; D25/65

(56) References Cited

U.S. PATENT DOCUMENTS

| | | | | | |
|---|---|---|---|---|---|
| 1,993,601 | A | | 3/1935 | Goldberg | 155/2 |
| 2,184,470 | A | | 12/1939 | Primavera | 155/2 |
| 2,362,426 | A | | 11/1944 | Wyatt | 155/2 |
| D145,938 | S | * | 11/1946 | Guild | |
| 2,656,881 | A | * | 10/1953 | Hamilton | |
| 2,709,119 | A | | 5/1955 | Chapman | 311/1 |
| D176,183 | S | * | 11/1955 | Goldman | D6/349 |
| 2,833,607 | A | | 5/1958 | Mackintosh | 311/4 |
| 2,842,412 | A | | 7/1958 | Mackintosh | 311/1 |
| 2,874,755 | A | | 2/1959 | Smith | 155/2 |
| 2,970,635 | A | | 2/1961 | Fields | 155/2 |
| RE25,985 | E | | 3/1966 | Klassen | 297/239 |
| RE26,071 | E | | 8/1966 | Rowland | 297/239 |
| 3,271,075 | A | * | 9/1966 | Good | |
| 3,316,016 | A | | 4/1967 | Petersen | 297/239 |
| 3,326,148 | A | * | 6/1967 | Jakobsen | |
| 3,446,530 | A | | 5/1969 | Rowland | 297/239 |
| D225,493 | S | * | 12/1972 | Rossi | |
| 3,734,561 | A | | 5/1973 | Barecki et al. | 297/239 |
| 3,847,433 | A | | 11/1974 | Acton et al. | 297/239 |
| 3,944,280 | A | | 3/1976 | Keeler | 297/239 |
| 4,130,316 | A | * | 12/1978 | Rossi | |
| D278,864 | S | * | 5/1985 | Borichevsky | |
| 4,548,294 | A | * | 10/1985 | Ruda | 182/228.2 |
| 4,763,580 | A | | 8/1988 | Garland | 108/91 |
| 4,852,944 | A | | 8/1989 | Hartmann | 297/445 |
| D363,824 | S | * | 11/1995 | Lyons | D6/349 |
| D379,887 | S | * | 6/1997 | Muller-Deisig | D6/484 |

* cited by examiner

*Primary Examiner*—Alvin Chin-Shue
(74) *Attorney, Agent, or Firm*—Roberts, Abokhair & Mardula, LLC

(57) ABSTRACT

A stackable step stool having a platform and obtusely angled legs where the design of the stackable step stool allows the stackable step stools to be stacked on top of one another in an alternating manner. The platform is typically rectangular with rounded corners. A raised ridge surrounds the top surface of the platform. The support frame consists of two inverted U-shaped legs. Each of the inverted U-shaped legs has a center portion with two obtusely angled leg portions extending from the center portion. The center portions of the inverted U-shaped legs attach to opposite sides of the platform. The obtusely angled legs are angled away from the platform such that the stackable step stools can be stacked on top of one another in an alternating manner. The stackable step stools are stacked on top of one another with the upper stackable step stool being displaced by at least the width of the legs. Additional stackable step stools can be stacked on top of the stack in an alternating manner. By stacking the stackable step stools in an alternating manner the stack stackable step stools preserve floor space and increase the stability of the stacked step stools.

10 Claims, 3 Drawing Sheets

STACKABLE STEP STOOL

FIELD OF THE INVENTION

The present invention relates to step stools and more specifically to stackable step stools. The design of the stackable step stools permits such stackable step stools to be stacked one on top of another to preserve floor space and increase the stability of the stacked objects.

BACKGROUND OF THE INVENTION

Stores typically stock products on shelves. If products cannot fit on shelves, a store may display those products on the floor. Products like chairs, tables, and stools typically cannot fit on shelves and therefore require floor space for display. Unfortunately, floor displayed products take a large amount of precious floor space which in turn limits the amount of floor space for other products. To combat this problem, some stores will only display a single floor model while other stores may display a very limited quantity of the product.

By displaying only a single floor model, customers may not be able to locate the single floor model. Once a customer locates the floor model, the customer must then find a worker to retrieve the desired product. In some cases, the product may be out of stock or the store may not have the desired quantity of the product in stock. All of these factors can lead to frustration for a customer. As a result, the store may lose a sale because the customer chooses to go to another store or the manufacturer may lose a sale because the customer chooses to purchase a similar product sold by a competitor.

Limiting the supply of a product being displayed also causes problems. For instance, if a customer buys the last product on display, the next customer may not be aware that the store sells that product. As a result, the store or manufacturer may lose a sale. If a customer wishes to buy a larger quantity than is displayed, the customer may choose to purchase a similar product sold by a competitor or go to another store to purchase the same product. Both of these examples demonstrate how a limited floor display can cost either the store or manufacturer money due to lost sales.

One viable option to overcome these problems is for manufactures to sell products that are stackable. By stacking the product, the manufacturer can ship more products because the products require less shipping space than if the products are shipped in stacks. By stacking the product, stores are able to display a larger supply of the product yet still save precious floor space.

Simply stacking items does not solve all of these problems, especially since manufacturers have been making stackable chairs and tables for years. Manufacturers typically make stackable products that still require a large amount of floor space because the stacks extend outwardly in one direction. Not only do the stacked items require additional floor space, but the stack becomes unstable and therefore unsafe if the stack keeps extending outwardly in one direction. As the stack becomes higher, the center of gravity for the stack keeps shifting in one direction, until the stack simply topples over.

An example of a stackable item which extends outwardly in one direction when stacked are the chairs shown in U.S. Pat. No. 3,316,016 to Petersen. A first chair is placed on the ground with additional chairs being placed on top of a lower chair with each chair extending the stack of chairs further out. The stack of chairs reaches a point where additional chairs can no longer be stacked on top because the stack will topple over.

The same problem occurs with tables or platform stages, as shown in U.S. Pat. Nos. 2,842,412 and 2,833,607, respectively, both to Mackintosh. Both of these inventions involve stackable items. However, in order to stack these items, the items are designed having trapezoidal shaped platforms to allow the tables and platforms to be stacked on top of each other. Again, the same stability problem is encountered since the stackable items extend outwardly creating unsafe stacks as well as requiring additional floor space.

This stacking and stability problem is not limited to trapezoidal shaped items. The same problem occurs with rectangularly shaped tables as shown in U.S. Pat. No. 3,326,148 to Jakobsen. Jakobsen's invention is for stackable tables, where the stack of tables extends outwardly with each additional table.

All of these stackable items face the same problems. They have all been designed to be stacked on top of one another and as a result, the stack extends further from vertical every time another item is stacked on top. Unfortunately, these items cannot be stacked in an alternating manner where all of the odd items share one plane and all of even items share another plane. The back supports of the chairs, as claimed by Petersen, prevent the chairs from being stacked in an alternating manner. The platforms and tables as claimed by Mackintosh cannot be stacked in an alternating manner because the items are trapezoidal shaped and the legs of the upper platforms interfere with the lower platforms. Even when the tables are rectangularly shaped, as claimed by Jakobsen, if the tables are stacked in an alternating method, the legs of an upper table will hit the legs of the table that are two below the upper table.

A need therefore exists for stacking stackable products in a safe manner. A further need exists for reducing the amount of space required for a stack of stackable products. If the legs of the tables and platforms were angled away from the table surface and platform, i.e., at an obtuse angle away from the table or platform, the tables and platforms can be stacked in an alternating manner thereby providing a safe stack as well as reducing the amount of space required for the stack.

SUMMARY OF THE INVENTION

It is therefore an object of the present invention to create a step stool structure that can be stacked, one on top of another in a stable, compact manner.

A further object of the present invention is to reduce the amount of floor space required to display a stack of stackable step stools.

A further object of the present invention is to reduce the amount of shipping space required to ship a stack of stackable step stools.

The present invention is a stackable step stool that can be stacked in a safe and sturdy manner. The design of the stackable step stool allows the stackable step stools to be stacked on top of one another in an alternating manner, thereby reducing the amount of space required for the stack of step stools. The stackable step stool comprises a platform and legs which are attached to the platform and are obtusely angled away from the platform. The platform can be rectangularly, square, circular, or oval shaped. The platforms include a raised ridge which surrounds the perimeter of the platform surface. To provide safety to a person using a stackable step stool, the surface of the platform is covered with a non-skid surface, although the presence of this non-skid surface is not meant as a limitation.

DETAILED DESCRIPTION OF THE INVENTION

Figure 1:
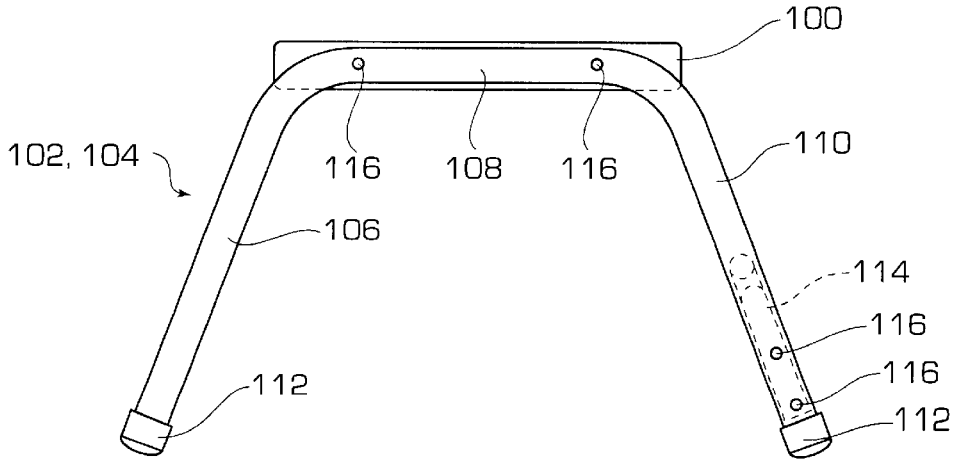
FIG. 1 is a side profile view of the stackable step stool.

Referring to FIG. 1, a side profile view of the stackable step stool is shown. In the preferred embodiment, the stackable step stool comprises platform 100, a first inverted U-shaped leg 102, and a second inverted U-shaped leg 104. (Second inverted U-shaped leg 104 is not shown in FIG. 1). First inverted U-shaped leg 102 and second inverted U-shaped leg 104 are attached to platform 100 by fastening means 116. Any suitable fastening means as known to one in the art can be used.

Each of the inverted U-shaped legs 102, 104 consists of three parts: center piece 108 and two obtusely angled leg portions 106, 110. In the preferred embodiment, each of the inverted U-shaped legs 102, 104 is made as one piece. In other embodiments, each of the inverted U-shaped legs 102, 104 is segmented. Obtusely angled leg portions 106, 110 attach to the distal ends of center piece 108. Although inverted U-shaped legs 102, 104 are referred to as being U-shaped, the legs are generally U-shaped. In the preferred embodiment, end caps 112 are attached to the distal ends of inverted U-shaped legs 102, 104.

In the preferred embodiment, at least one crossbar 114 (shown in FIG. 4) is attached to each inverted U-shaped leg 102, 104 as support. Crossbar 114 is attached to each inverted U-shaped leg 102, 104 by a fastening means 114. Any suitable fastening means as known to one skilled in the art can be used.

Figure 2:
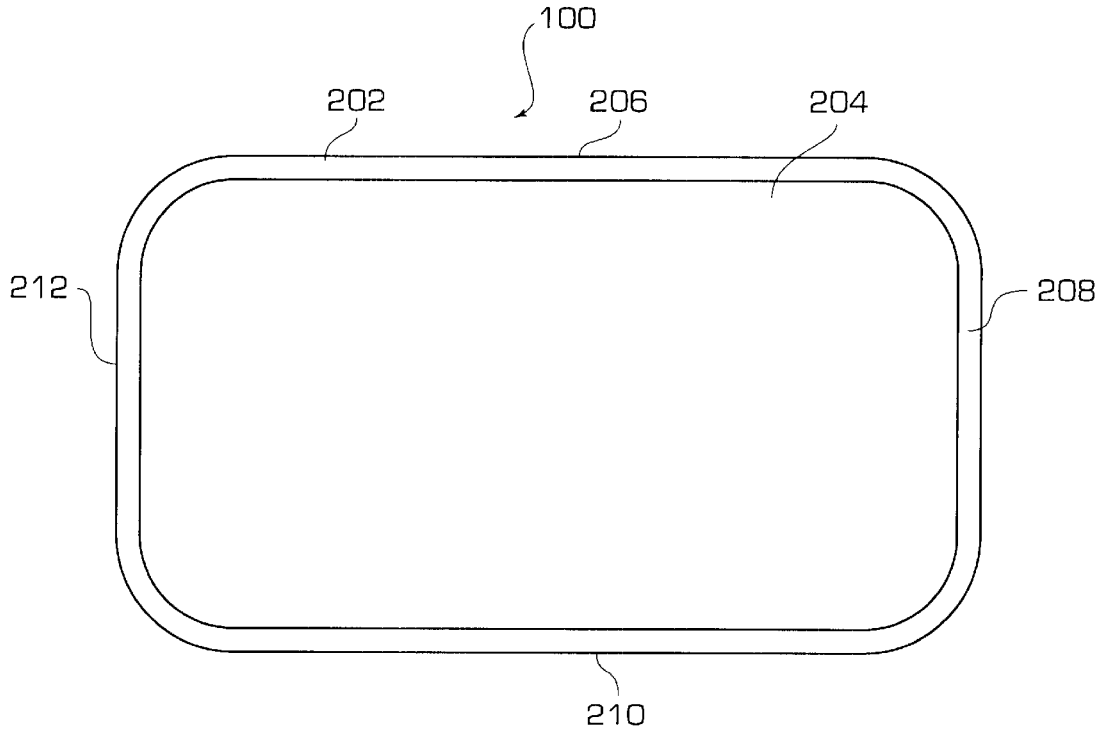
FIG. 2 is a view of the top of the platform for the preferred embodiment.

Referring to FIG. 2, a preferred embodiment having a raised ridge surrounding the platform is shown. As shown, raised ridge 202 surrounds the perimeter of platform 100. In the preferred embodiment, raised ridge 202 is an integral part of platform 100 with the upper and lower portions of raised ridge 202 being curled. The curled portion is positioned so that the user cannot see any machined or cut edges on the ridge. Since the curled upper portion is raised, the curled portion provides a smooth transition between raised ridge 202 and platform surface 204. To help prevent a person from slipping on the stackable step stool, a non skid surface is applied to platform surface 204. In the preferred embodiment, the non skid surface is an adhesive sheet. In an alternate embodiment, strips of non skid surfaces are applied to platform surface 204. These various nonskid surfaces are meant as examples only and should not be construed as a limitation. Any non-slip surface is considered to be within the scope of the present invention.

In the preferred embodiment, platform 100 is rectangular. Platform 100 comprises a first side 206, a second side 208, a third side 210, and a forth side 212. First side 206 and third side 210 are the same length. First side 206 and third side 210 are on opposite sides of each other. Second side 208 and fourth side 212 are the same length. Second side 208 and fourth side 212 are on opposites sides of each other. First side 206 and third side. 210 are longer in length than second side 208 and fourth side 212.

In the preferred embodiment, first inverted U-shaped leg 102 is attached to second side 208 and second inverted U-shaped leg 104 is attached to fourth side 212. Fastening means 116 attaches center piece 108 of first inverted U-shaped leg 102 to second side 208. Fastening means 116 attaches center piece 108 of second inverted U-shaped leg 104 to fourth side 212.

In an alternate embodiment, first inverted U-shaped leg 102 is attached to first side 206 and second inverted U-shaped leg 104 is attached to third side 210. Fastening means 116 attaches center piece 108 of first inverted U-shaped leg 102 to first side 206. Fastening means 116 attaches center piece 108 of second inverted U-shaped leg 104 to third side 210.

In an alternate embodiment, first side 206, second side 208, third side 210, and fourth side 212 are the same length. In yet another embodiment, the sides where the inverted U-shaped legs are not attached, are curved.

Figure 3:
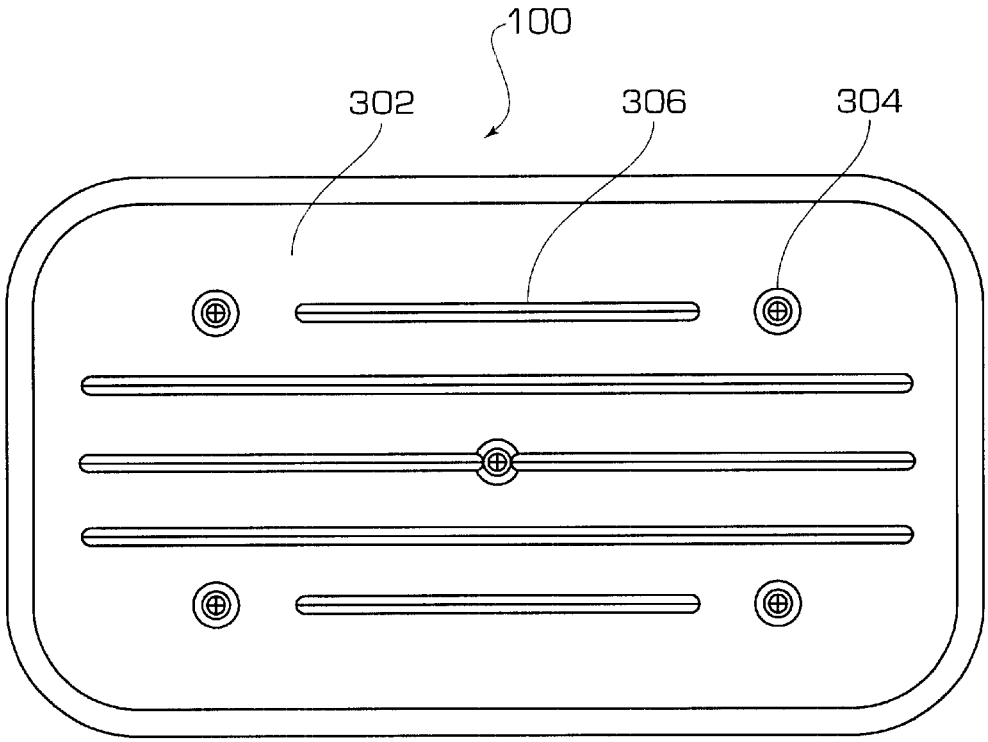
FIG. 3 is a view of the top of the platform for an alternate embodiment.

Referring to FIG. 3, the top view of an alternate embodiment for platform 100 is shown. As shown, platform surface 302 is a separate piece which attaches to platform 100 by fastening means 304. Any suitable fastening means as known to one skilled in the art can be used. Raised ridges or grooves 306 are used to allow a user's feet to better grip the platform surface.

Figure 4:
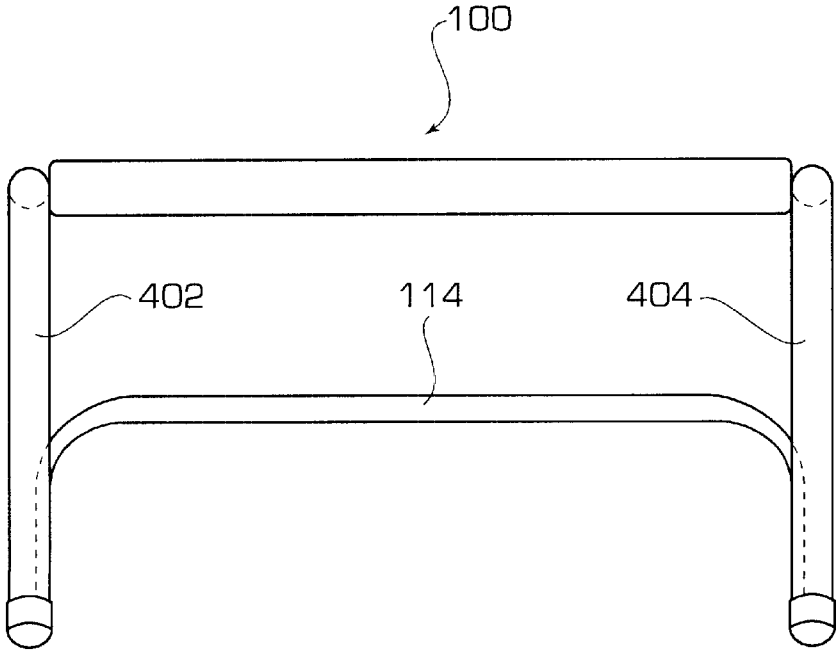
FIG. 4 is a front or rear view of the stackable step stool.

Referring to FIG. 4, the front or rear view of the stackable step stool is shown. Platform 100 is rectangularly shaped and has U-shaped legs 402, 404 attached to the width sides of platform 100. Crossbar 114 connects a leg portion of inverted U-shaped leg 402 to a leg portion of inverted U-shaped leg 404. As shown, crossbar 114 attaches to both of the leg portions on the same side of the stackable step stool. End caps 112 are attached to the bottom of inverted U-shaped legs 402,404.

Figure 5:
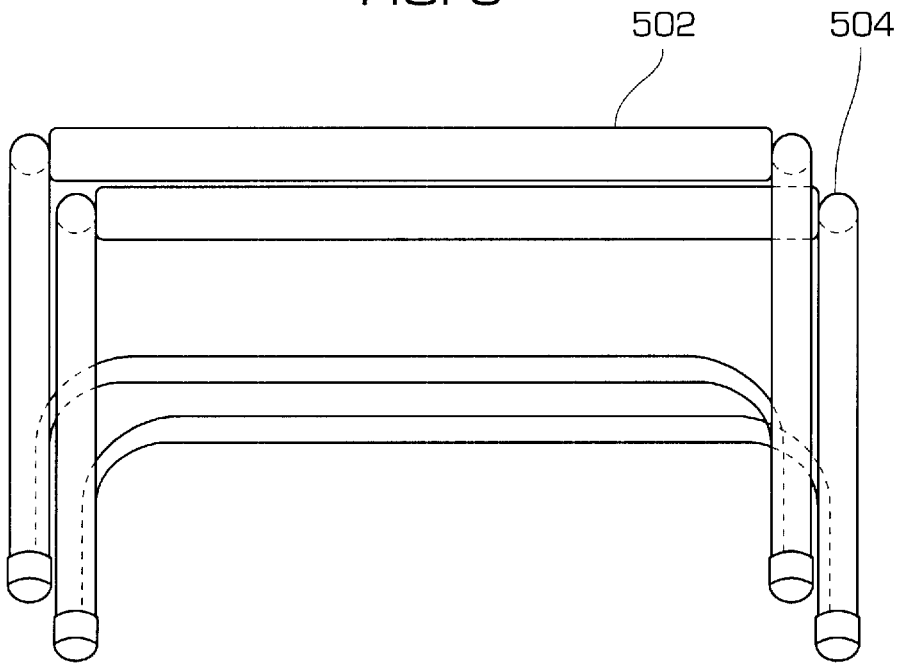
FIG. 5 is a front or rear view of the stackable step stools in the stacked position.

Referring to FIG. 5, the stackable step stools in the stacked position as viewed from either the front or rear are shown. Stackable step stool 502 is stacked on top of stackable step stool 504. Stackable step stool 502 would be displaced from stackable step stool 504 by at least the width of the legs. An additional stackable step stool can be stacked on top of stackable step stool 502, this additional step stool can be stacked in the same plane as stackable step stool 504 or the additional stackable step stool could be displaced from stackable step stool 502 by at least the width of the legs. Additional stackable step stools can be stacked in a similar manner, for instance a third stackable step stool can be stacked on top of stackable step stool 502 in the same plane as stackable step stool 504 and a forth stackable step stool can be stacked on top of the third stackable step stool in the same plane as stackable step stool 502.

Alternatively, the third stackable step stool can be stacked on top of stackable step stool 502 where the third stackable step stool is displaced from stackable step stool 502 by at least the width of the legs. A forth stackable step stool can be stacked on top of the third stackable step stool in either a new plane, being displaced by at least the width of the legs, or it can be stacked in the same plane as stackable step stool 502.

Any additional stackable step stools can be stacked on top by alternating the positioning of the stackable step stools. By stacking the step stools in such a manner, the stack of step stools takes less space and reduces the risk of the step stools falling over because the stack's center of gravity is close to the center of gravity for one step stool.

The design of the stackable step stools allows a stackable step stool to be stacked on top of another with each stackable step stool being displaced from the stackable step stool below by at least the width of the legs. The design of the stackable step stools allows one stackable step stool to be stacked on top of another stackable step stool in a sturdy and safe manner.

Although the apparatus of the present invention has been described in detail for purpose of illustration, it is understood that such detail is solely for that purpose, and variations can be made therein by those skilled in the art without departing from the scope of the invention as disclosed. The apparatus of the present invention is defined by the following claims:

We claim:

1. A stackable step stool for stacking with respect to adjacent step stools, the stackable step stool comprising:

a platform, and a support frame;

wherein said platform comprises:

a substantially rectangular support surface, a first side disposed at a first edge of said support surface, a second side disposed at a second edge of said support surface, a third side disposed at a third edge of said support surface, opposite said first side, and a fourth side disposed at a fourth edge of said support surface, opposite said second side; and wherein said support frame comprises: a first inverted U-shaped support, and a second inverted U-shaped support;

wherein said first inverted U-shaped support comprises: a first center portion between and connected to a first front leg and a first rear leg, wherein said second inverted U-shaped support comprises: a second center portion between and connected to a second front leg and a second rear leg, wherein said first and second center portions are attached to opposite ones of said sides of said platform, wherein the stackable step stool is securely stackable so that it is free to be offset, by about one leg width in either of two opposing directions, with respect to each of the adjacent step stools, and wherein said platform further comprises a ridge around the perimeter of said support surface.

2. A stackable step stool for stacking with respect to adjacent step stools, the stackable step stool comprising:

a platform, a support frame, and at least one cross bar;

wherein said platform comprises:

a substantially rectangular support surface with rounded corners and a raised ridge around the perimeter of the support surface, a first side disposed at a first edge of said support surface, a second side disposed at a second edge of said support surface, a third side disposed at a third edge of said support surface, opposite said first side, and a fourth side disposed at a fourth edge of said support surface, opposite said second side;

wherein said support frame comprises: two U-shaped supports, wherein each of said U-shaped supports comprises a center portion and two obtusely angled leg portions, said center portion being between and connected to said two obtusely angled leg portions, and wherein the center portions of the two U-shaped supports are each attached by a fastener to said platform;

wherein said at least one cross bar connects one obtusely angled leg of one of said U-shaped supports to one obtusely angled leg of the other one of said U-shaped supports, where both of the connected obtusely angled leg portions are located on a common side of said platform, wherein the stackable step stool is securely stackable so that it is free to be offset, by about one leg width in either of two opposing directions, with respect to each of the adjacent step stools.

3. The stackable step stool of claim 2, wherein said support surface comprises a non slip surface.

4. The stackable step stool of claim 3, wherein said non slip surface is an adhesive sheet.

5. The stackable step stool of claim 3, wherein said non slip surface is a plurality of adhesive strips.

6. The stackable step stool of claim 2, wherein said support surface comprises raised ridges.

7. The stackable step stool of claim 2, wherein said support surface comprises grooves.

8. The stackable step stool of claim 2, wherein each of said two inverted U-shaped supports are one piece.

9. The stackable step stool of claim 2, wherein each of said two inverted U-shaped supports further comprises segments.

10. A stack of step stools comprising:

a plurality of stackable steep stools, wherein each one of said plurality of stackable step stools comprises:

a substantially rectangular platform, and a support frame, said support frame comprising: a first inverted U-shaped support, and a second inverted U-shaped support;

wherein said first inverted U-shaped support comprises: a first center portion between and connected to a first front leg and a first rear leg, wherein said second inverted U-shaped support comprises: a second center portion between and connected to a second front leg and a second rear leg, wherein said first and second center portions are attached to opposite ones of said sides of said platform, and wherein the plurality of stackable step stools are offset in a sequentially alternating manner.

* * * * *